US007805817B2

(12) United States Patent
Deto

(10) Patent No.: US 7,805,817 B2
(45) Date of Patent: Oct. 5, 2010

(54) END STOP FOR SLIDE FASTENER

(75) Inventor: Tatsuya Deto, Toyama-ken (JP)

(73) Assignee: YKK Corporation, Tokyo (JP)

( * ) Notice: Subject to any disclaimer, the term of this patent is extended or adjusted under 35 U.S.C. 154(b) by 1532 days.

(21) Appl. No.: 10/990,623

(22) Filed: Nov. 17, 2004

(65) Prior Publication Data

US 2009/0165266 A1 Jul. 2, 2009

(30) Foreign Application Priority Data

Nov. 20, 2003 (JP) ..... 2003-390782

(51) Int. Cl.
*A44B 19/24* (2006.01)
*A44B 19/36* (2006.01)

(52) U.S. Cl. ..... 24/436

(58) Field of Classification Search ..... None
See application file for complete search history.

(56) References Cited

U.S. PATENT DOCUMENTS 2,161,329 A 6/1939 Wittenberg
2,546,649 A * 3/1951 Morin ..... 24/433
2,564,649 A 3/1951 Morin
2,988,796 A * 6/1961 Johns ..... 24/436
4,752,922 A * 6/1988 MacAnally et al. ..... 369/30.15

FOREIGN PATENT DOCUMENTS

JP 49-106504 9/1974

* cited by examiner

*Primary Examiner*—Jack W. Lavinder
(74) *Attorney, Agent, or Firm*—Alston & Bird LLP

(57) ABSTRACT

This invention relates to a top end stop having a substantially U-shaped section and a bottom end stop having a substantially lateral-H shaped section. In each end stop, leg portions having key-shaped sections, i.e., a hook shaped portion is provided at front ends thereof, are extended in a bent manner from a rectangular base portion, so that an accommodation portion surrounded by the base portion and a pair of leg portions is provided for accommodating a core portion. A row of a projecting portion is formed continuously/intermittently on an inner face of the base portion and a gap portion is provided between the projecting portion and the root of each leg portion. The projecting portion positions the core portion accurately and holds it, and in crimping the leg portions, the core portion is compressed, and the gap portion is filled thereby, so that the core portion is secured firmly.

9 Claims, 9 Drawing Sheets

END STOP FOR SLIDE FASTENER

BACKGROUND OF THE INVENTION

1. Field of the Invention

This present invention relates to an end stop for a slide fastener for stopping a sliding of a slider, namely, a top end stop or a bottom end stop made of metal, secured adjacent to fastener elements of a slide fastener employing a fastener tape provided with a core portion on a side edge thereof.

2. Description of the Related Art

According to a conventionally known slide fastener disclosed in U.S. Pat. No. 2,161,329, as shown in FIG. 15, a top end stop for a slide fastener secured on a swollen core portion 123 formed on a side edge of a fastener tape 122 is employed. In the top end stop, a metal plate is bent into a fallen U shape, projecting portions 108 are provided on each of front and rear ends of a central base portion such that the projecting portions 108 project inward and leg portions 105 are formed on both sides of the base portion while plural ribs (not shown) are provided protrudedly on an inner faces of the leg portions 105. Consequently, the top end stop 101 is fixed on the core portion 123 of the fastener tape 122 by crimping.

Further, according to Japanese Utility Model Application Laid-Open No. 49-106504, another type of an end stop is disclosed, as shown in FIG. 16. In the end stop, front and rear leg portions 205 are formed with a section of a substantially fallen U shape such that they are connected or separated so as to include an insertion groove 215. On a side wall 213 at a proximal portion inside of this insertion groove 215, plural protruded pieces 211 are provided so as to engage between metallic plural interlocking elements or fastener elements (not shown) mounted on a fastener tape, and a hook shaped portion 206 is formed at a front end on an inner face of the insertion groove 215 or a front end of each leg portion 205 such that the hook shaped portion 206 is bent inward, so that this top end stop 201 can be secured to the fastener tape.

In the top end stop 101 of the slide fastener shown in FIG. 15, in order to make a projecting amount of the top end stop from the core portion 123 of the fastener tape 122 constant, the projecting portions 108 are provided on both ends of the top end stop 101 so as to limit the projecting amount. Despite an advantage of this limitation, since the top end stop 101 is secured on the core portion 123 by a pressure from the ribs provided on the inner face of the leg portions 105 between the projecting portions 108, the core portion 123 cannot be captured firmly in a vicinity of the projecting portions 108 because the projecting portions 108 are obstacles. For the reason, no effective fixing result can be expected because the top end stop 101 cannot secure the core portion 123 entirely.

The top end stop 201 for a slide fastener shown in FIG. 16 cannot be used commonly for various kinds of interlocking elements, namely, fastener elements and is used according to a size and a shape of the fastener elements. For the reason, several kinds of the top end stops should be prepared and selected depending on the fastener element type and then mounted on fastener stringers. As a result, cost increases to induce an uneconomical condition and it is also inconvenient.

Accordingly, the present invention has been achieved in views of the above-described problems and a prominent object of the present invention is to provide an end stop for a slide fastener, in which a core portion of a fastener tape is held securely in an accommodation portion within the end stop and the positioned core portion is captured along the entire length and across the entire width of the accommodation portion in the end stop and fixed strongly.

Further, another object of the present invention is to provide an end stop for a slide fastener, in which the shape of a projecting portion to be provided within the accommodation portion in the end stop is specified so that the core portion can be accurately positioned, and easily pressed and deformed within the accommodation portion.

SUMMARY OF THE INVENTION

To achieve the above-described object, according to the prominent configuration of the present invention, there is provided a end stop for a slide fastener, in which a pair of leg portions are extended from a base portion in a bent manner, the base portion being substantially rectangular or rectangular piped, an accommodation portion for accommodating a core portion of a fastener tape is provided, the accommodation portion being surrounded by the base portion and the leg portions, a projecting portion is provided on an inner face of the base portion in a protruding manner, a gap portion is provided between the projecting portion and a root of each leg portion, so that an expanded core portion provided on a side edge of the fastener tape can be fixed within the accommodation portion surrounded by the base portion and the leg portions.

The projecting portion on the inner face of the base portion is formed such that it projects continuously into the accommodation portion or such that it projects intermittently into the accommodation portion. Alternatively, the projecting portion may be formed in a substantially same thickness as the fastener tape on which the end stop is to be attached.

Further, a protruded portion is formed on an inner face of a leg portion so as to be protruded into the accommodation portion, and this protruded portion is formed along an entire length of the end stop with a constant width. Additionally, a projection portion is formed on the inner face of the leg portion so as to be protruded into the accommodation portion. The projection portion may be formed in a form of an independent protrusion having a predetermined width and length at necessary places. Further, the protruded portion and the projection portion may be formed such that they project into the accommodation portion.

According to the present invention, the bottom end stop may be formed by providing both faces of the base portion with pairs of leg portions in a bent manner so that accommodation portions each surrounded by the base portion and the leg portions are provided symmetrically. Of course, the top end stop may be formed by providing a single face of the base portion with the pair of leg portions in a bent manner and providing the single face of the base portion with the accommodation portion surrounded by the base portion and leg portions. In this case, it is permissible to provide further a locking piece projecting from a front end face of the leg portion extended in a bent manner from the base portion of the end stop. In this case, preferably, the projection portion is provided at a root of the locking piece on the inner face of the leg portion provided at a front end of the leg portion such that the projection portion is protruded into the accommodation portion.

With the above-described configuration, the present invention exerts following various operations and effects.

The projecting portion provided on the inner face of the base portion accurately positions the core portion of the fastener tape disposed within the accommodation portion, and facilitates crimping work by the leg portions. In addition, when the leg portions are crimped to hold the core portion disposed within the accommodation portion, a gap portion provided between the projecting portion and the root of each leg portion allows the core portion along the entire length and across the entire width of the accommodation portion to be deformed and can capture the deformed portion easily.

Further, the projecting portion is formed continuously so as to project into the accommodation portion or intermittently so as to project into the accommodation portion, or is formed in substantially the same thickness as the fastener tape. Consequently, the core portion can be positioned accurately in the accommodating portion and the core portion within the accommodation portion can be easily and effectively pressed and deformed.

Additionally, the protruded portion is formed on the inner face of the leg portion such that it projects into the accommodation portion, or the projection portion is provided such that it projects into the accommodation portion. Alternatively, both of the protruded portion and the projection portion are formed such that they project into the accommodating portion. As a result, the core portion disposed within the accommodation portion can be captured securely by the protruded portion and the projection portion and nipped strongly, thereby completely preventing the top end stop from deviating on the core portion.

When the bottom end stop is formed by providing the leg portions on both faces of the base portion in a bent manner so that the accommodation portions are provided on both sides, the bottom end stop achieves an excellent function. Further the leg portions are provided on a single face of the base portion so that the accommodation portion is formed on a single side, and the locking piece projecting sideways is provided at the front end on one side of the leg portion or the protruded portion is formed at the root of the locking piece on the inner face of the leg portion such that the protruded portion projects into the accommodation portion. Accordingly, a top end stop having an excellent function can be produced, this top end stop can stop a slider easily, and additionally, the top end stop bites into the core portion of the fastener tape strongly, so that it never deflect in position even if the slider collides violently, thereby ensuring an excellent quality as the top end stop.

DESCRIPTION OF THE PREFERRED EMBODIMENTS

Figure 1:
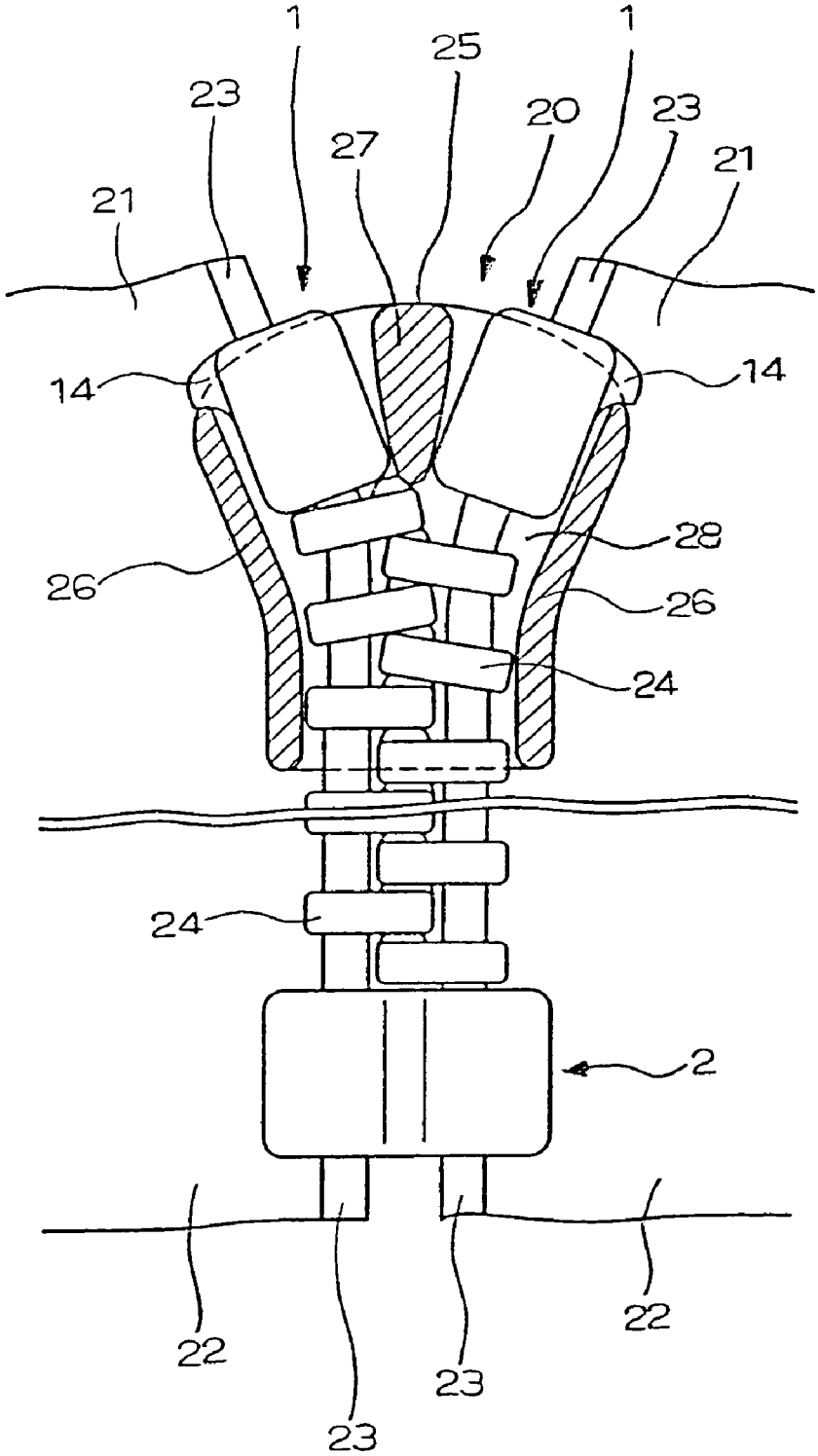
FIG. 1 is a front view of a slide fastener on which an end stop according to a first embodiment of the present invention is attached.

An end stop for a slide fastener of the present invention includes a top end stop 1 and a bottom end stop 2 to be attached to top and bottom ends of a slide fastener as shown in FIG. 1. The top end stop 1 and bottom end stop 2 are made of metallic material such as zinc alloy and aluminum alloy by die-casting, or by extrusion, rolling, cutting and polishing process. The top end stop 1 is attached to a side edge at a top end of a fastener stringer 21, and the bottom end stop 2 is mounted at a bottom end of the fastener chain 20 such that it crosslinks right and left fastener stringers 21. The top end stop 1 has a substantially U shaped section so that an opening portion at the front end is slightly expanded. The bottom end stop 2 has a substantially lateral H shape so that opening portions on both sides are slightly expanded.

The top end stop 1 is comprised of a rectangular or rectangular piped base portion 4 whose central portion is flat and leg portions 5 having a key-shaped section, that is, each having a hook shaped portion 12 at a front end stretching from its longer side. The top end stop further contains an accommodation portion 7 which is surrounded by the base portion 4 and the leg portions 5, for accommodating a core portion 23. Further, a row of narrow projecting portion 8 is provided on an inner face of the base portion 4, and this projecting portion 8 is formed continuously or intermittently along an entire length of the top end stop 1 so that a gap portion 9 is formed between the projecting portion 8 and roots of the leg portions 5, into which the core portion 23 can escape when the core portion 23 is pressed and deformed.

Each of the leg portions 5 of the top end stop 1 has a protruded portion 10 or a projection portion 11 or both the protruded portion 10 and the projection portion 11, and the hook shaped portion 12 formed at the front end thereof. Under this condition, the leg portions 5 are pressed from above and beneath and deformed, namely crimped so as to secure the core portion 23 firmly. Further, the top end stop 1 has a locking piece 14 which projects sideways at the front end on one side of each leg portion 5, so that it comes into contact with a flange 26 of a sliding slider 25 so as to stop the slider 25.

First Embodiment

As shown in FIG. 1, the end stop for a slide fastener of the present invention concerns the top end stop 1 attached to the core portion 23 on each side edge of right and left fastener stringers 21 at the top end of a fastener chain 20 and the bottom end stop 2 mounted at the bottom end of the fastener chain 20 such that it crosslinks the right and left fastener stringers 21.

Figure 2:
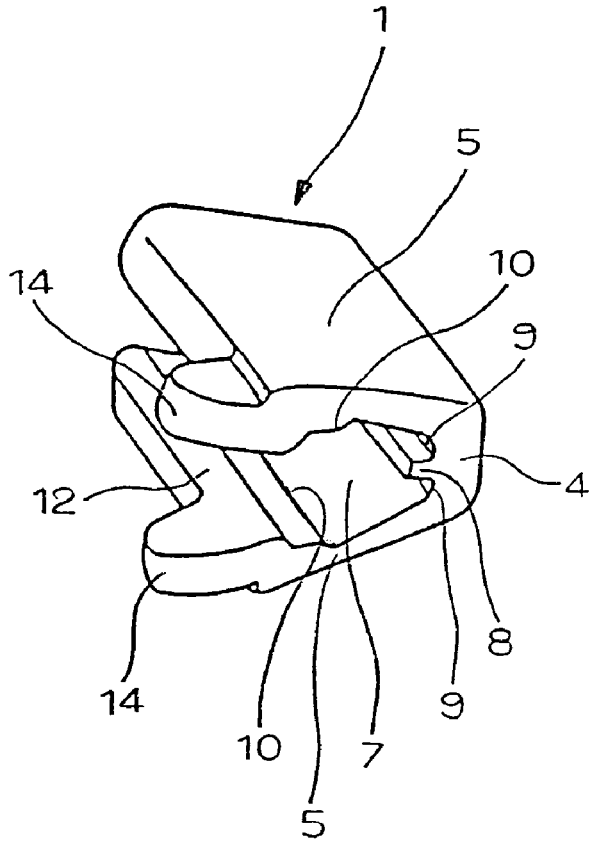
FIG. 2 is a perspective view of the same top end stop.
Figure 3:
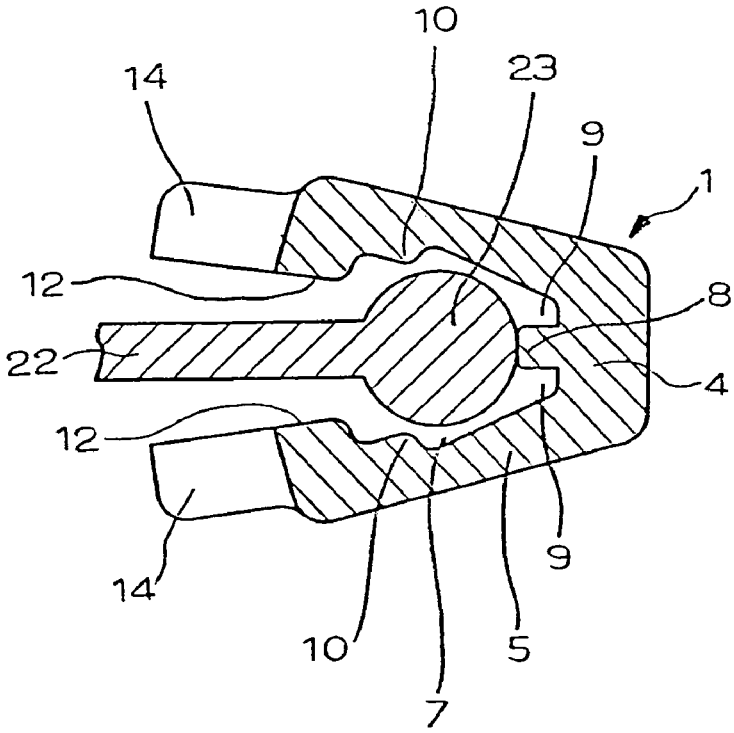
FIG. 3 is a sectional view showing the condition in which a core portion is inserted into the same top stop end.
Figure 4:
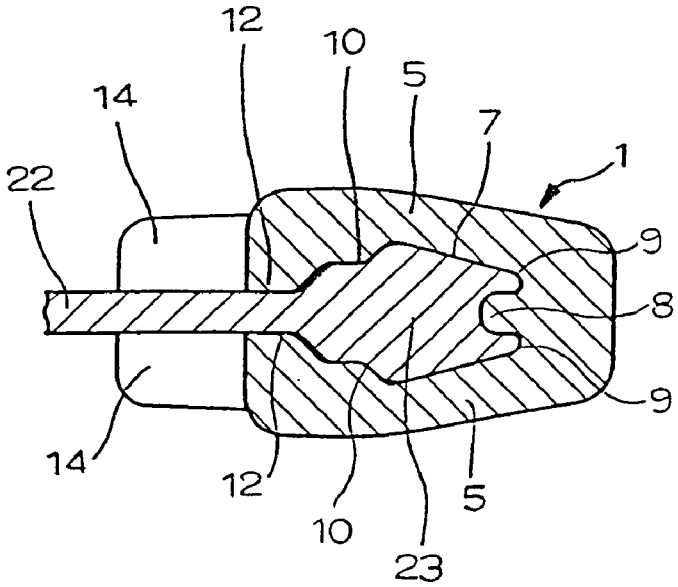
FIG. 4 is a sectional view showing the condition in which the top end stop is crimped to the core portion.

A end stop for a slide fastener according to a first embodiment of the invention shown in FIGS. 2 to 4 concerns the top end stop 1, and this top end stop 1 has a substantially U shaped section as shown in FIGS. 3 and 4 so that the opening portion at the front end thereof is slightly expanded, whereby the core portion 23 of the fastener tape 22 can be inserted. The top end stop 1 has the rectangular or rectangular piped base portion 4 which is flat at the central portion and the leg portions 5 each having a key-shaped section are extended in a bent manner from the upper and lower long sides of the base portion 4 substantially in parallel. The hook shaped portion 12 is provided at each front end of the leg portions 5 and the accommodation portion 7 surrounded by the base portion 4 and the leg portions 5 for accommodating the core portion 23 is provided.

A row of narrow projecting portion 8 is provided on the inner face of the base portion 4 along the entire length of the top end stop 1 such that the projecting portion 8 projects toward the accommodation portion 7. When the core portion 23 is accommodated in the accommodation portion 7, as shown in FIG. 3, the core portion 23 is brought into a contact with the projecting portion 8 so as to position the core portion 23 accurately and hold the core portion 23. Further, the gap portion 9 is provided between the projecting portion 8 and the leg portion 5, so that when upper and lower leg portions 5 are pressed and deformed, namely, crimped, as shown in FIG. 4, the core portion 23 can escape into the gap portion 9, thereby this gap portion being filled.

A row of protruded portion 10 which is swollen along the entire length of the inner face of each of the upper and lower leg portions 5 is provided so that the core portion 23 accommodated in the accommodation portion 7 is nipped by crimping, and the top end stop 1 is secured to the core portion 23 firmly. The small protruded locking piece 14 is provided at a front end of one side of each of the upper and lower leg portions 5 such that it projects sideways of the fastener stringer 21. At the time of crimping, the locking pieces 14 nip the fastener tape 22 from front and rear sides, so that when the slider 25 placed on the fastener chain 20 slides, the locking pieces 14 come into contact with the flanges 26 of the slider 25 thereby inhibiting the slider 25 from sliding.

As regards the usage condition of the top end stop 1, the top end stop 1 is crimped on a part of the core portion 23 adjacent the fastener elements 24 of the fastener stringer 21 which is symmetrical between its front and rear faces, on which fastener elements 24 formed of metal or resin independently to one another are mounted along the side edge of the fastener tape 22. The top end stop of this type or the top end stop 1 in which the locking piece is disposed at the front end of the leg portion 5 is produced by die-casting means using zinc alloy or aluminum alloy.

Second Embodiment

Figure 5:
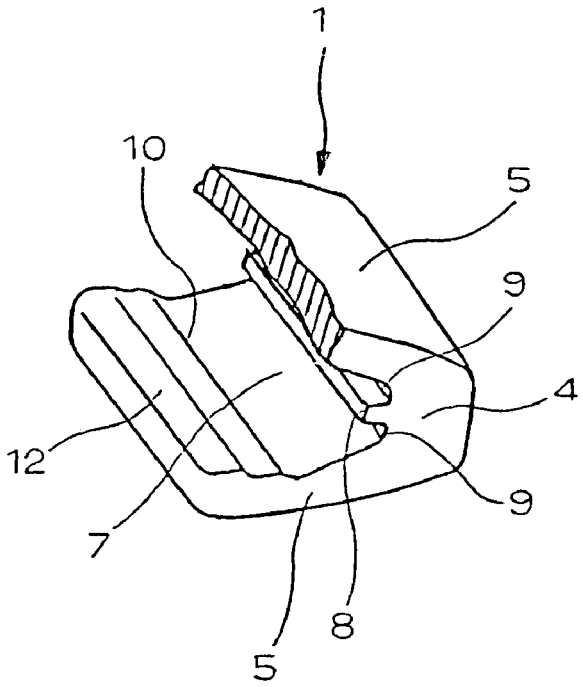
FIG. 5 is a partially broken perspective view of a top end stop according to a second embodiment of the present invention.
Figure 6:
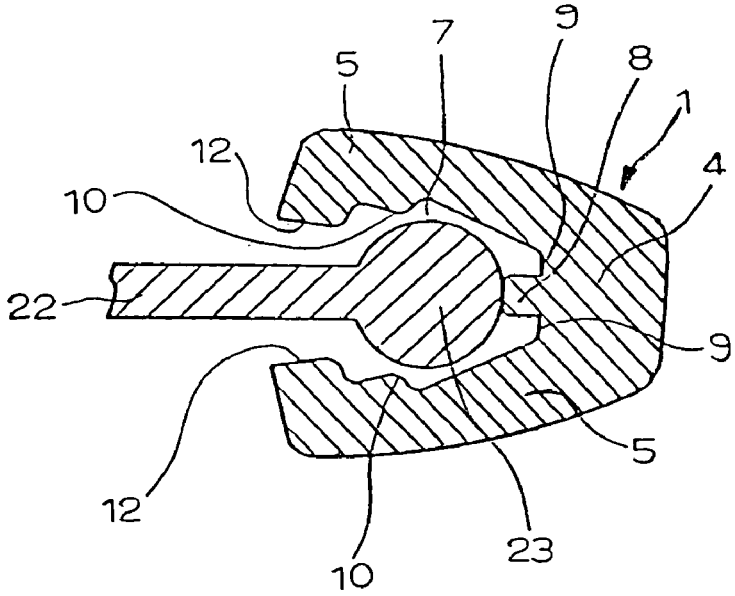
FIG. 6 is a sectional view showing the condition in which a core portion is inserted in the same top end stop.
Figure 7:
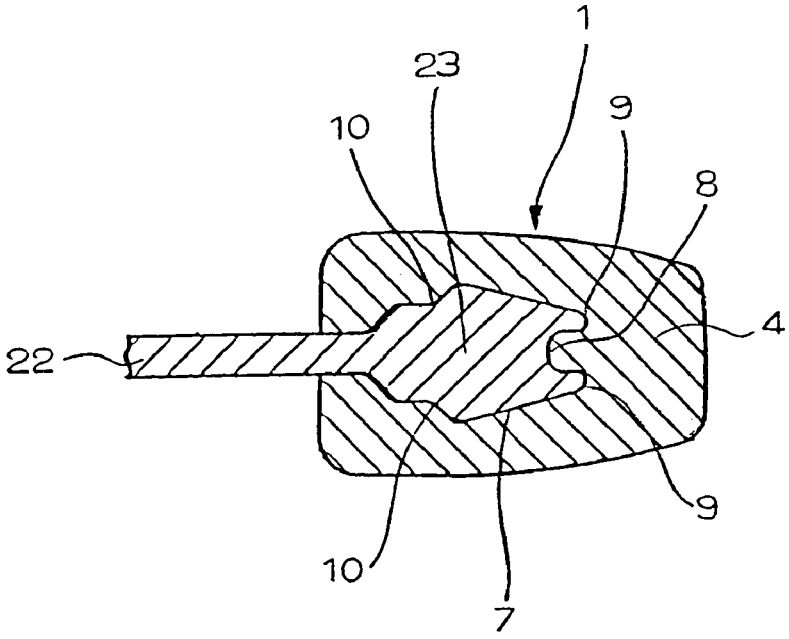
FIG. 7 is a sectional view showing the condition in which the top end stop is crimped to the core portion.

Next, an end stop for a slide fastener according to a second embodiment of the invention shown in FIGS. 5 to 7 concerns the top end stop 1. Although the top end stop of this type is substantially of the same configuration as the above-described first embodiment, it is different from the first embodiment in that no locking piece is provided at the front end of the leg portion 5 and the base portion 4 of the top end stop 1 is formed thicker, while the other structures are completely the same. A row of the projecting portion 8 is provided on the inner face of the base portion 4 of the top end stop 1, and further, the gap portion 9 is provided between the projecting portion 8 and the root of the leg portion 5. In addition, the accommodation portion 7 is provided such that it is surrounded by the base portion 4 and the leg portions 5, so that the core portion 23 of the fastener tape 22 disposed in the accommodation portion 7 is positioned accurately within the accommodation portion 7. The row of the protruded portion 10 which is swollen along the entire length is provided on the inner face of the leg portion 5, and at the time of crimping the leg portions 5, the core portion 23 is pressed and deformed so that it can be secured firmly.

As regards the usage condition of this top end stop 1, the top end stop 1 is attached to the top end of each of the right and left fastener stringers 21 of the fastener chain 20 such that the top end stop adjoins the fastener elements 24. When the slider 25 inserted through the fastener chain 20 is slid, the top end stop 1 comes into contact with both a guide post 27 and the flange 26 of the slider 25 due to the thick base portion 4 of the top end stop 1, thereby generating a friction resistance. As a result, the top end stop 1 does not pass through an element guide groove 28, and thus a function of stopping the slider 25 is provided. Although the top end stop 1 can be formed by die-casting using metallic material, it is permissible to form by extruding a bar material having a section in which the opening portion of the top end stop is expanded, rolling, cutting into a required size for the top end stop and polishing it.

Third Embodiment

Figure 8:
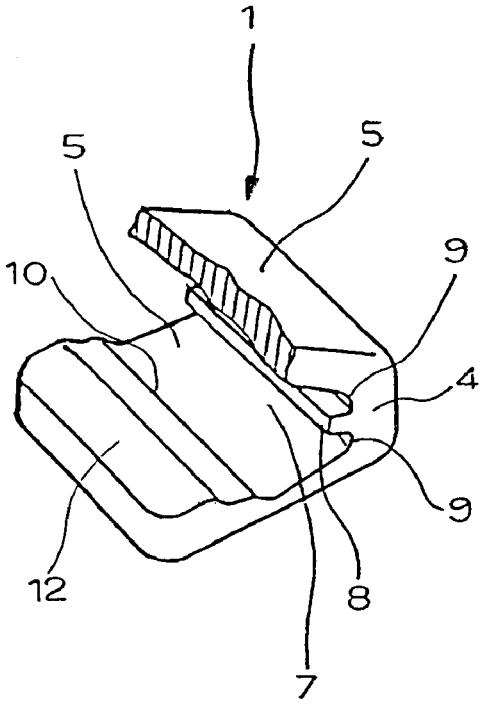
FIG. 8 is a partially broken perspective view of a top stop end according to a third embodiment of the present invention.

As regards a end stop for a slide fastener according to a third embodiment of the invention shown in FIG. 8, no locking piece is provided at the front end of the leg portion 5 of the top end stop 1, the base portion 4 of the top end stop 1 is formed thicker, so that when the slider 25 is slid, it comes into a sliding contact with both the guide post 27 and the flange 26 of the slider 25, thereby generating a friction resistance, and consequently, the top end stop 1 does not pass through the element guide groove 28, as shown in the second embodiment. In the top end stop 1 shown in FIG. 8, the base portion 4 is formed in the same thickness as that of the base portion 4 of the top end stop 1 of the first embodiment, and the projecting width of the hook shaped portion 12 at the front end of the leg portion 5 is formed larger. As a result, the hook shaped portion 12 projects sideways further than a side end of upper and lower leg portions of the fastener elements 24 and then, the flange 26 of the slider 25 comes into contact with it, thereby inhibiting the slider 25 from sliding.

Fourth Embodiment

Figure 9:
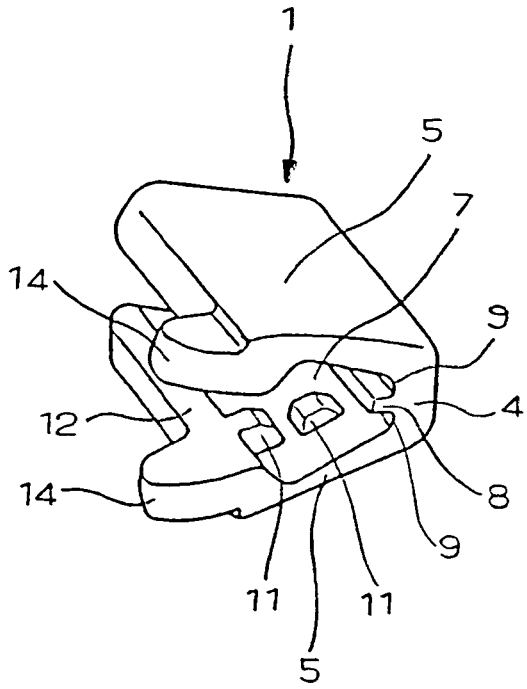
FIG. 9 is a perspective view of a top end stop according to a fourth embodiment of the present invention.
Figure 10:
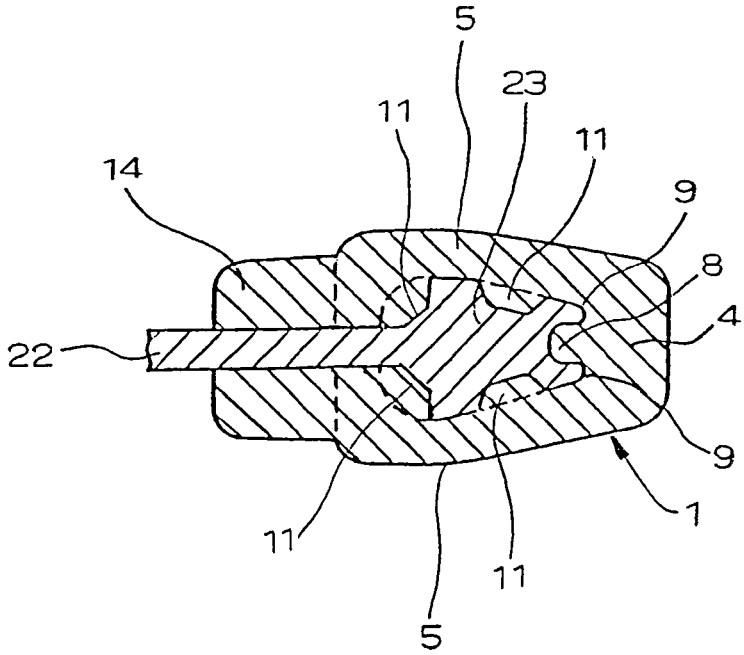
FIG. 10 is a sectional view showing the condition in which the top end stop is crimped to a core portion.

In a top end stop 1 for a slide fastener according to a fourth embodiment of the invention shown in FIGS. 9 and 10, a row of the projecting portion 8 is provided on the inner face of the base portion 4, and additionally, the gap portion 9 is provided between the projecting portion 8 and the root of the leg portion 5. In addition, the accommodation portion 7 is provided so that the core portion 23 disposed in the accommodation portion 7 is positioned. Consequently, at the time of crimping, the core portion 23 can escape, thereby easily filling the gap portion. On the other hand, plural projection portions 11 which are protruded in forms of small protrusions are provided on the inner face of each leg portion 5, and the locking piece 14 is provided projectedly at the front end of the leg portion 5. When the leg portions 5 are pressed to crimp the top end stop 1, the projection portions 11 bite into the core portion 23, so that the top end stop 1 can be secured firmly to the core portion 23. Further, in case of the top end stop 1 of this type, preferably, the projection portions 11 are provided inside of the hook shaped portion 12 having the locking piece 14 so as to fix the locking piece 14 in a stable condition.

Fifth Embodiment

Figure 11:
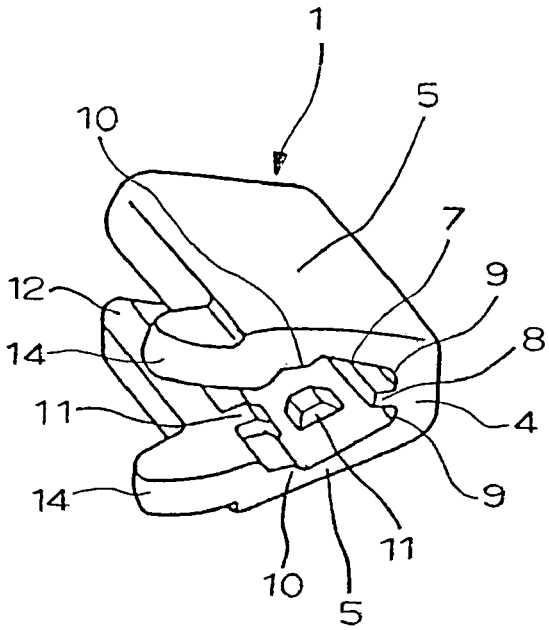
FIG. 11 is a perspective view of a top end stop according to a fifth embodiment of the present invention.
Figure 12:
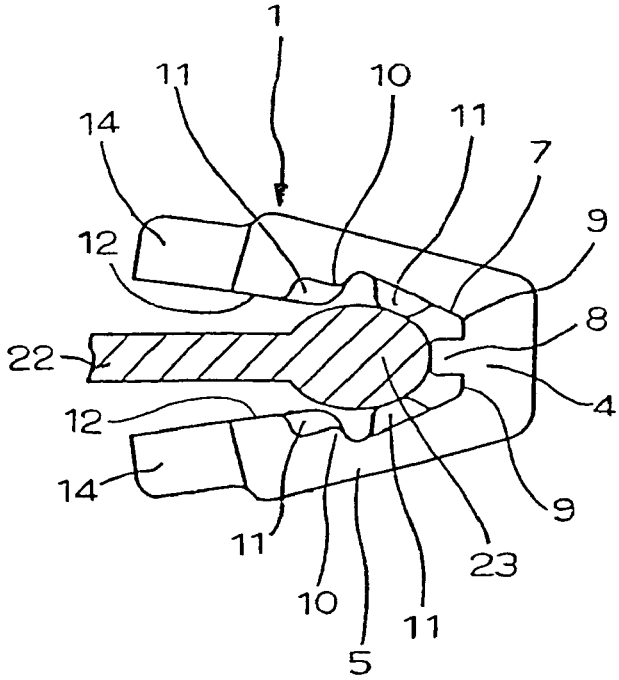
FIG. 12 is a partially broken sectional view showing the condition in which a core portion is inserted into the same top end stop.

In a top end stop 1 for a slide fastener according to a fifth embodiment of the invention shown in FIGS. 11 and 12, a row of the projecting portion 8 is provided on the inner face of the base portion 4, and additionally, the gap portion 9 is provided between the projecting portion 8 and the root of the leg portion 5. Further, the accommodation portion 7 is formed by the base portion 4 and the leg portions 5, so that the core portion 23 disposed within the accommodation portion 7 is positioned. At the time of crimping, the core portion 23 is made to escape into the gap portion 9, thereby filling the gap portion. Consequently, the top end stop 1 is secured firmly. In addition, the protruded portion 10 which is swollen along the entire length of the inner face of each leg portion 5 is provided, and plural projection portions 11 are provided in the forms of small protrusions. The feature of this embodiment is provision of the protruded portion 10 and the plural projection portions 11 at the same time. Accordingly, the core portion 23 disposed within the accommodation portion 7 is pressed strongly and secured firmly. Additionally, the locking piece 14 is provided at the front end of the leg portion 5, and the projection portions 11 are provided inside of the locking piece 14 so as to secure the locking piece 14 in a stable condition. The usage condition is same as described above.

Sixth Embodiment

Figure 13:
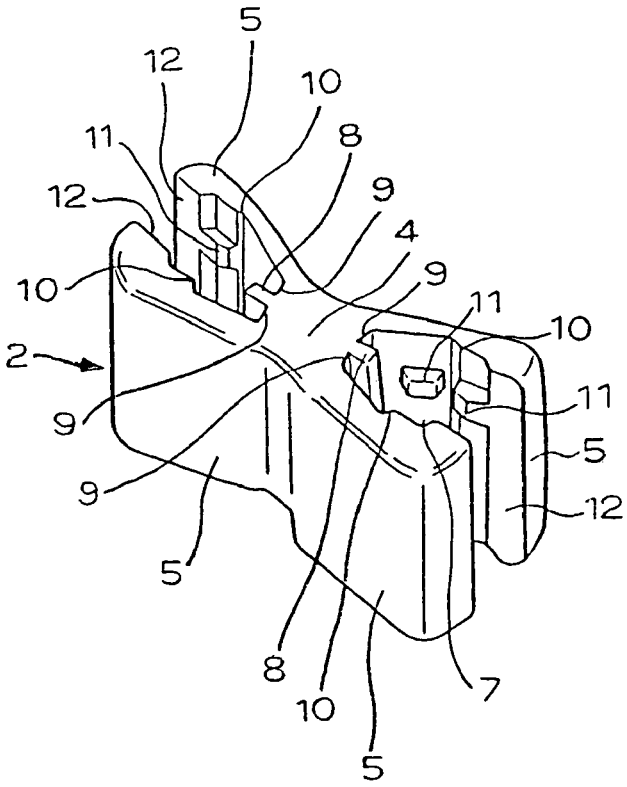
FIG. 13 is a perspective view of a bottom end stop according to a sixth embodiment of the present invention.
Figure 14:
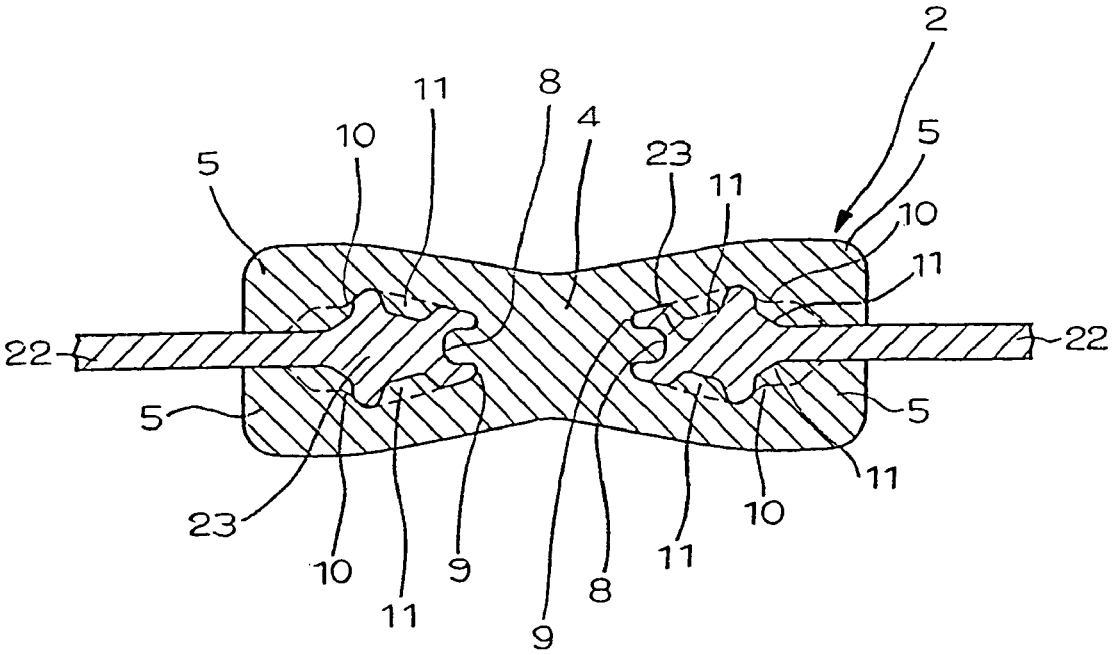
FIG. 14 is a sectional view showing the condition in which the bottom end stop is crimped to a core portion.
Figure 15:
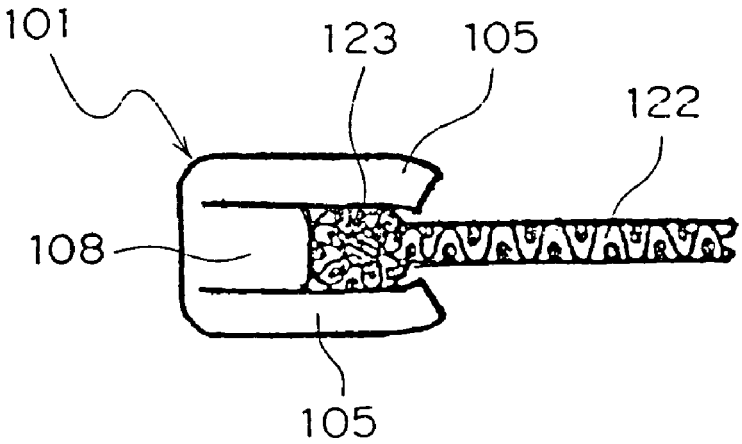
FIG. 15 PRIOR ART
FIG. 15 is a sectional view showing a mounting condition of a well known top end stop.
Figure 16:
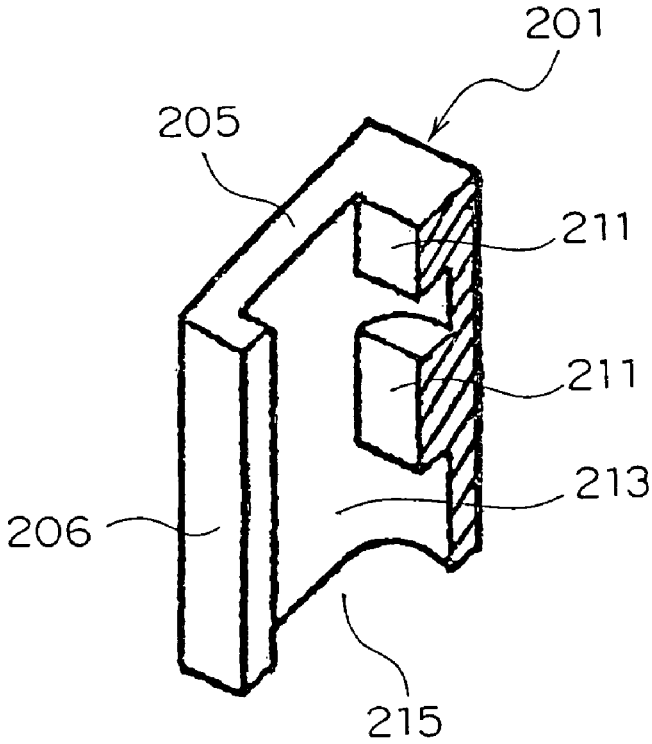
FIG. 16 PRIOR ART
FIG. 16 is a partially omitted perspective view of another well known top end stop.

An end stop for a slide fastener according to a sixth embodiment of the invention shown in FIGS. 13 and 14 concerns the bottom end stop 2 provided at a bottom end of the fastener chain 20 in the slide fastener such that they crosslink the right and left fastener stringers 21. The entire sectional shape of the bottom end stop 2 represents a substantially H shape as shown in FIG. 13, in which the narrow projecting portion 8 is provided protrudedly on each of both sides of a column or rectangular piped base portion 4 in a center so that the core portion 23 is positioned. Then, the leg portions 5 each having a key shaped section are provided projectedly such that they extend forward of each of upper and lower ends of the base portion. The accommodation portion 7 surrounded by the base portion 4 and the leg portions 5 is provided, and the gap portion 9 is provided between the base portion 4 and the root of each leg portion 5, so that the core portion 23 can escape, thereby filling the gap portion. The hook shaped portion 12 is formed at the front end of the leg portion 5.

A row of the protruded portion 10 which is swollen along the entire length of the inner face of each of the upper and lower leg portions 5 is provided, and plural projection portions 11 are provided in the forms of small protrusions such that they protrude into the accommodation portion 7. The core portions 23 accommodated by both accommodation portions 7 are crimped so that they are nipped by the hook shaped portions 12, the projection portions 11 and the protruded portions 10, so as to close a bottom end of the fastener chain 20. At this time, the bottom end stop 2 is disposed across the core portions 23 having no fastener elements 24 such that it adjoins the fastener elements 24 of each of the right and left fastener stringers 21. Consequently, the bottom end stop 2 comes into contact with a rear mouth of the slider 25, thereby stopping the sliding of the slider 25.

INDUSTRIAL APPLICABILITY

The end stop for the slide fastener of the present invention concerns a part of the slide fastener. In a metallic slide fastener in which independent interlocking elements or fastener elements 24 are formed of metallic material such as zinc alloy and aluminum alloy and mounted on front and rear surfaces of fastener tapes 22 such that they are symmetrical, or in a resin slide fastener in which the independent fastener elements 24 are formed on the front and rear surfaces of the fastener tape 22 by injection molding using thermoplastic resin such as polyacetal and polyamide such that they are symmetrical, this end stop is employed as the top end stop 1 and bottom end stop 2 of the slide fastener.

What is claimed is:

1. An end stop for a slide fastener, including a top end stop and a bottom end stop disposed at top and bottom ends of a slide fastener, in which a pair of leg portions are extended from a base portion in a bent manner, an accommodation portion surrounded by the base portion and leg portions is provided, and a projecting portion is provided in a center of a width direction of an inner face of the base portion and extended along a length direction of the inner face of the base portion, the projection portion is formed in a shape which is continuously projecting toward the accommodation portion, a gap portion is provided between the projecting portion and a root of each leg portion so that a core portion provided on a side edge of a fastener tape can be fixed along the length direction of the base portion within the accommodation portion, and the core portion is stored in at least a part of the gap portion.

2. The end stop for a slide fastener according to claim 1, wherein the projecting portion is formed in a substantially same thickness as the fastener tape.

3. The end stop for a slide fastener according to claim 1, wherein a protruded portion is formed on an inner face of the leg portion such that it projects into the accommodation portion.

4. The end stop for a slide fastener according to claim 1, wherein a projection portion is formed on an inner face of the leg portion such that it projects into the accommodation portion.

5. The end stop for a slide fastener according to claim 1, wherein a protruded portion and a projection portion are formed on an inner face of the leg portion such that they project into the accommodation portion.

6. The end stop for a slide fastener according to claim 1, wherein the bottom end stop comprises the leg portions provided on both faces of the base portion in a bent manner and accommodation portions provided on both sides of the base portion.

7. The end stop for a slide fastener according to claim 1, wherein the top end stop comprises the leg portions provided on a single face of the base portion in a bent manner and the accommodation portion formed on a single side of the base portion.

8. The end stop for a slide fastener according to claim 7, wherein the top end stop comprises a locking piece projecting sideways at a front end on one side of each leg portion.

9. The end stop for a slide fastener according to claim 8, wherein a projection portion is provided at a root of the locking piece on an inner face of the leg portion so as to project into an accommodation portion.

* * * * *